US007753501B2

(12) United States Patent
Hatasa et al.

(10) Patent No.: US 7,753,501 B2
(45) Date of Patent: Jul. 13, 2010

(54) LIQUID SUPPLY SYSTEM AND INK JET RECORDING APPARATUS

(75) Inventors: Nobuyuki Hatasa, Kawasaki (JP); Hideki Ogura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 762 days.

(21) Appl. No.: 11/783,443

(22) Filed: Apr. 10, 2007

(65) Prior Publication Data

US 2007/0257974 A1 Nov. 8, 2007

(30) Foreign Application Priority Data

May 2, 2006 (JP) ..... 2006-128136

(51) Int. Cl.
*B41J 2/17* (2006.01)

(52) U.S. Cl. ..... 347/84; 347/85; 347/86

(58) Field of Classification Search ..... 347/84–87
See application file for complete search history.

(56) References Cited

U.S. PATENT DOCUMENTS 6,554,411 B1 4/2003 Hatasa et al. ..... 347/86
6,702,427 B2 3/2004 Shimizu et al. ..... 347/50
6,824,258 B2 11/2004 Yamamoto et al. ..... 347/86
6,877,848 B2 * 4/2005 Shimizu et al. ..... 347/86
7,055,941 B2 6/2006 Tsurui et al. ..... 347/86
7,118,204 B2 10/2006 Hatasa et al. ..... 347/86
7,178,908 B2 * 2/2007 Katayama ..... 347/85
7,264,342 B2 9/2007 Yamamoto et al. ..... 347/86
2004/0100540 A1 5/2004 Hatasa et al. ..... 347/86
2006/0146107 A1 7/2006 Tsurui et al. ..... 347/86
2007/0229632 A1 10/2007 Hatasa et al. ..... 347/92

FOREIGN PATENT DOCUMENTS

JP 2001-270131 10/2001
JP 2001-293880 10/2001

* cited by examiner

*Primary Examiner*—Juanita D Stephens
(74) *Attorney, Agent, or Firm*—Fitzpatrick, Cella, Harper & Scinto

(57) ABSTRACT

This liquid supply system has a liquid storing portion, and a first communication hole and a second communication hole formed in the bottom of the liquid storing portion. The liquid supply system has a gas circulation mode of leading a gas in the liquid storing portion to the outside through the second communication hole and forcing the gas into the liquid storing portion through the first communication hole.

11 Claims, 15 Drawing Sheets

LIQUID SUPPLY SYSTEM AND INK JET RECORDING APPARATUS

BACKGROUND OF THE INVENTION

1. Field of the Invention

The present invention relates to a liquid supply system, and more particularly to a liquid supply system suitable for use as a system for supplying ink to a recording head of an ink jet recording apparatus.

2. Description of the Related Art

The ink jet recording apparatus is an apparatus for forming a desired image on a recording medium, by spraying ink drops from a fine discharge port installed in a recording head and bumping the ink drops onto the recording medium. The ink jet recording apparatus has employed an ink mainly using dye. However, a recorded matter which has employed the ink using dye has insufficient light resistance and weathering resistance, and is unsuitable for use requiring the light resistance and the weathering resistance, such as articles intended for outdoor display. For this reason, an ink using pigment instead of dye is used. However, the pigment is not a dissolving system but a dispersing system, so that the ink using pigment occasionally causes the sedimentation of pigment particles in an ink tank.

The ink using pigment tends to cause a problem particularly in a structure of statically setting an ink tank accommodating a pigmented ink, in a main body of an ink jet recording apparatus of a serial type, which produces records while moving a recording head. Specifically, the ink using pigment occasionally causes a considerable sedimentation of pigment though depending on the frequency of use of a recording apparatus, the interval of use and the number of printed sheets. In a recoding apparatus having an out carriage tank separately arranged at a place apart from the recording head, the ink tank has occasionally a large capacity for the purpose of reducing the frequency of exchanging the tank. However, even in the tank with the large capacity, the pigment has occasionally sedimented.

When an ink tank is left alone in the state of being mounted on an ink jet recording apparatus for a long period of time, pigment particles slowly sediment in the ink tank. As a result of this, an inclination of the pigment particle concentration forms in a direction toward an upper part from the bottom of the ink tank. Accordingly, an excessively dark color layer forms in the bottom because of high pigment particle concentration, and an excessively light color layer forms in the upper part because of low pigment particle concentration. When ink is supplied from an ink tank having a structure of leading the ink from the bottom of the ink tank to a recording head, the ink is supplied first from the layer having the high pigment particle concentration and produces a printed matter with an excessively dark color. Therefore, there was a case where the recorded matter printed by using the ink in an early using stage of the ink tank showed an easily-visible difference of print density from that by using the ink in a latter stage of use.

The phenomenon is remarkable in a color printed matter in which an image is expressed by a difference of color density. In order to solve such a problem, Japanese Patent Application Laid-Open No. 2001-270131 and Japanese Patent Application Laid-Open No. 2001-293880 propose technologies. These patent documents disclose a technology of holding ink with an absorber in an ink tank, and arranging a tubular pipe having such a plurality of holes so as to communicate with an ink supply port of a tank, inside the tank. When a recording head sucks the ink, the ink existing in the pipe is sucked outside the tank by way of the supply port. The ink is sucked outside by way of a plurality of holes arranged in a vertical direction of the ink tank. In the structure, the ink of different concentrations is sucked from a plurality of the holes arranged in a vertical direction of the pipe in the tank, and is temporarily stored in the pipe. The ink is then supplied from the pool (pipe). Thereby, the structure uniformizes ink concentration and can alleviate the unevenness of pigment concentration due to sedimentation which occurs while being left for a long period of time in the ink tank.

In addition, U.S. Pat. No. 6,824,258 discloses a configuration in which an ink tank is connected to a recording apparatus, and air bubbles rise in a tank when ink is lead out. A structure is arranged in an upper space of the rising bubbles in the tank so as to disturb the rise of the bubbles. Then, the bubbles collide with the structure and agitate pigment particles in the tank. USP2004100540 discloses a configuration in which the ink is directly stored in the ink tank, and the air introduced from the outside of the tank circulates in a pipe installed in the ink tank and agitates pigment particles therein.

However, in configurations disclosed in these documents, pigmented ink in a tank is agitated by making use of an action such as ink sucking operated when a recording apparatus is recovered. The action includes, for instance, an operation of leading the sedimented pigment ink to the outside of the ink tank, a recovery operation carried out when removing bubbles in a recording head, and the operation for charging the ink into the recording head. Every time when these operations are performed, the ink in the tank is wastefully consumed though the pigment particles are agitated. Particularly, when the ink has a large difference of pigment concentration in the tank, the ink needs to be agitated many times before the concentration of the pigment of the ink in the tank is uniformized to the optimal pigment concentration. As a result of this, a large amount of the ink is inevitably drained outside the tank, so that the ink capable of being used originally in printing is wastefully drained.

SUMMARY OF THE INVENTION

The present invention is made with respect to such a technical problem. An object of the present invention is to provide a liquid supply system which does not waste ink and keeps a pigment concentration in a liquid containing pigment particles uniform by preventing the pigment particles from sedimenting, even when the liquid is used for a long period of time.

Another object of the present invention is to provide an ink jet recording apparatus which can record an adequate image with desired printing density, by using the liquid supply system.

In order to achieve the above described objects, a liquid supply system according to the present invention, to and from which a liquid storing container is capable of being attached and detached so as to direct a first communication hole and a second communication hole in a vertically downward direction, the liquid storing container being provided with a liquid storing portion, the first communication hole and the second communication hole that are arranged in one side face of the liquid storing portion, and a cylindrical member that is connected to the second communication hole and is installed in the liquid storing portion, the liquid supply system being provided with a first flow path for connecting the first communication hole with a recording head; a second flow path for communicating the second communication hole to outside air; a third flow path for connecting the first flow path with the second flow path, and a driving unit for a gas or a liquid, wherein the driving unit leads a gas stored in the liquid storing portion outside the liquid storing portion by way of the cylindrical member and the second flow path and returns the gas into the liquid storing portion through the first communication hole by way of the third flow path and the first flow path so that the gas can circulate again.

Furthermore, the present invention also provides an ink jet recording apparatus including: the recording head which discharges ink to a recording medium to record an image on the basis of image information; and the liquid supply system which supplies the ink stored in the liquid storing container to the recording head.

According to the present invention, a liquid supply system is provided, which does not waste ink and keeps a pigment concentration in a liquid containing pigment particles uniform by preventing the pigment particles from sedimenting, even when the liquid is used for a long period of time.

An ink jet recording apparatus according to another present invention can record an adequate image of desired printing density, by using the liquid supply system.

Further features of the present invention will become apparent from the following description of exemplary embodiments with reference to the attached drawings.

DESCRIPTION OF THE EMBODIMENTS

Figure 9:
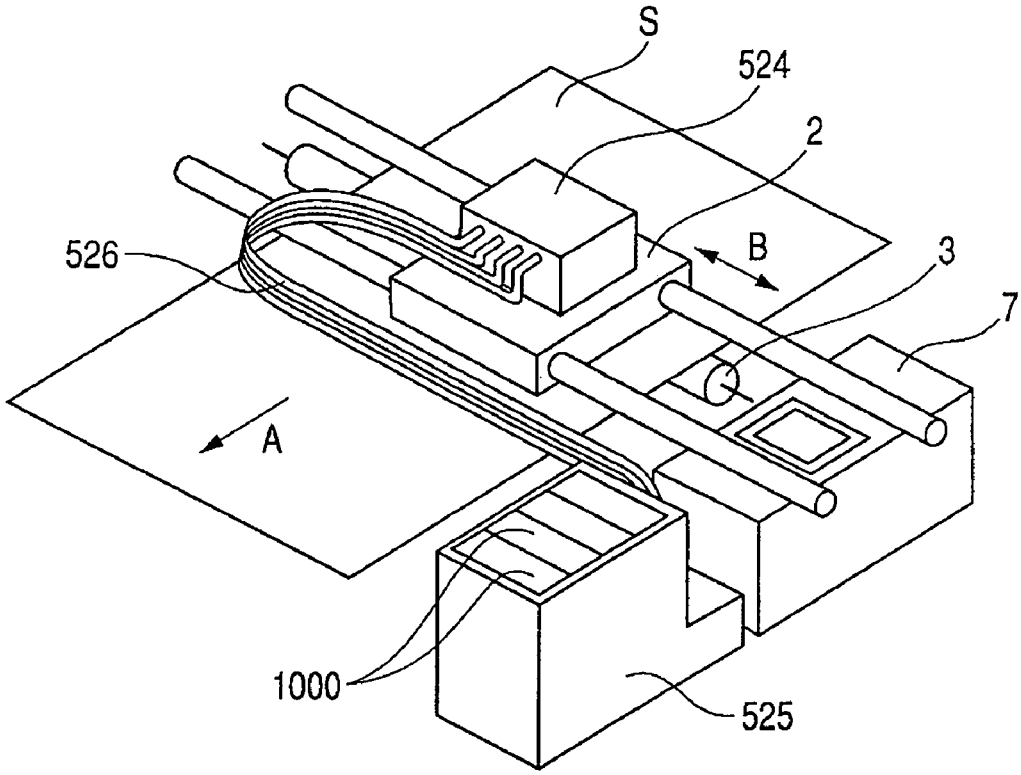
FIG. 9 is a perspective view of an ink jet recording apparatus employing a liquid supply system according to the present invention.

In the next place, embodiments according to the present invention will be described specifically with reference to the drawings. FIG. 9 is a perspective view of an ink jet recording apparatus which employs a liquid supply system according to the present invention. In FIG. 9, the ink jet recording apparatus is configured so as to discharge ink to a recording medium (S) from a recording head 524 on the basis of image information, and to record an image (including a character and a symbol) on the recording medium (S). The recording head 524 is mounted on a carriage 2. The ink jet recording apparatus produces records by transporting the recording medium (S) in a transportation direction (A) (vertical scanning direction) with a transportation roller 3, and reciprocating the carriage 2 in a direction (B) (main scanning direction) which intersects to the vertical scanning direction. The ink jet recording apparatus drives the recording head 524 on the basis of the image information in synchronization with the movement of the carriage, and makes the recording head discharge the ink to the recording medium. The ink jet recording apparatus produces records on the whole recording medium by transporting the recording medium (S) with a predetermined pitch with the transportation roller 3, and alternately repeating the transportation with the predetermined pitch and the production of a record corresponding to one line. The recording medium (S) can employ various articles, but normally employs a sheet-shaped article such as a recording paper and a plastic sheet.

A recording head 524 has a discharge port array having a plurality of discharge ports arranged in series in a vertical scanning direction formed in a discharging plane which faces to a recording medium (S). The recording head 524 has a plurality of the discharge port arrays corresponding to the number of types of ink to be used, and when producing color records or gradated records, makes different discharge port columns discharge different types of ink to form a desired image. The recording head 524 is supplied with each color ink from a plurality of ink tanks 1000 corresponding to the respective color inks. The ink tank is detachably mounted on an ink supply unit 525, and supplies ink to the recording head through an ink supply path 526 such as a tube.

Figure 1:
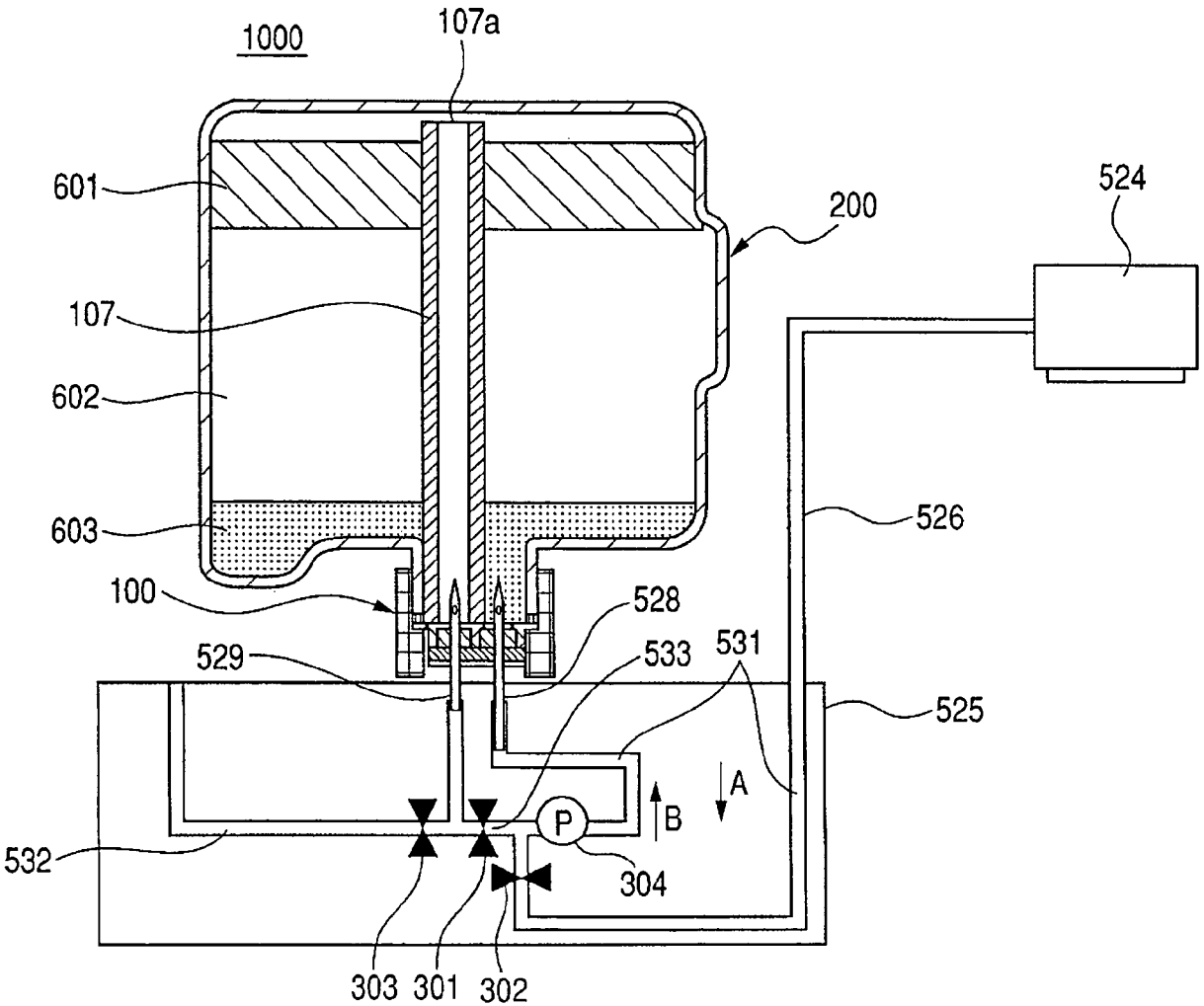
FIG. 1 is a schematic block diagram of a liquid supply system according to the first embodiment in the present invention.
Figure 2:
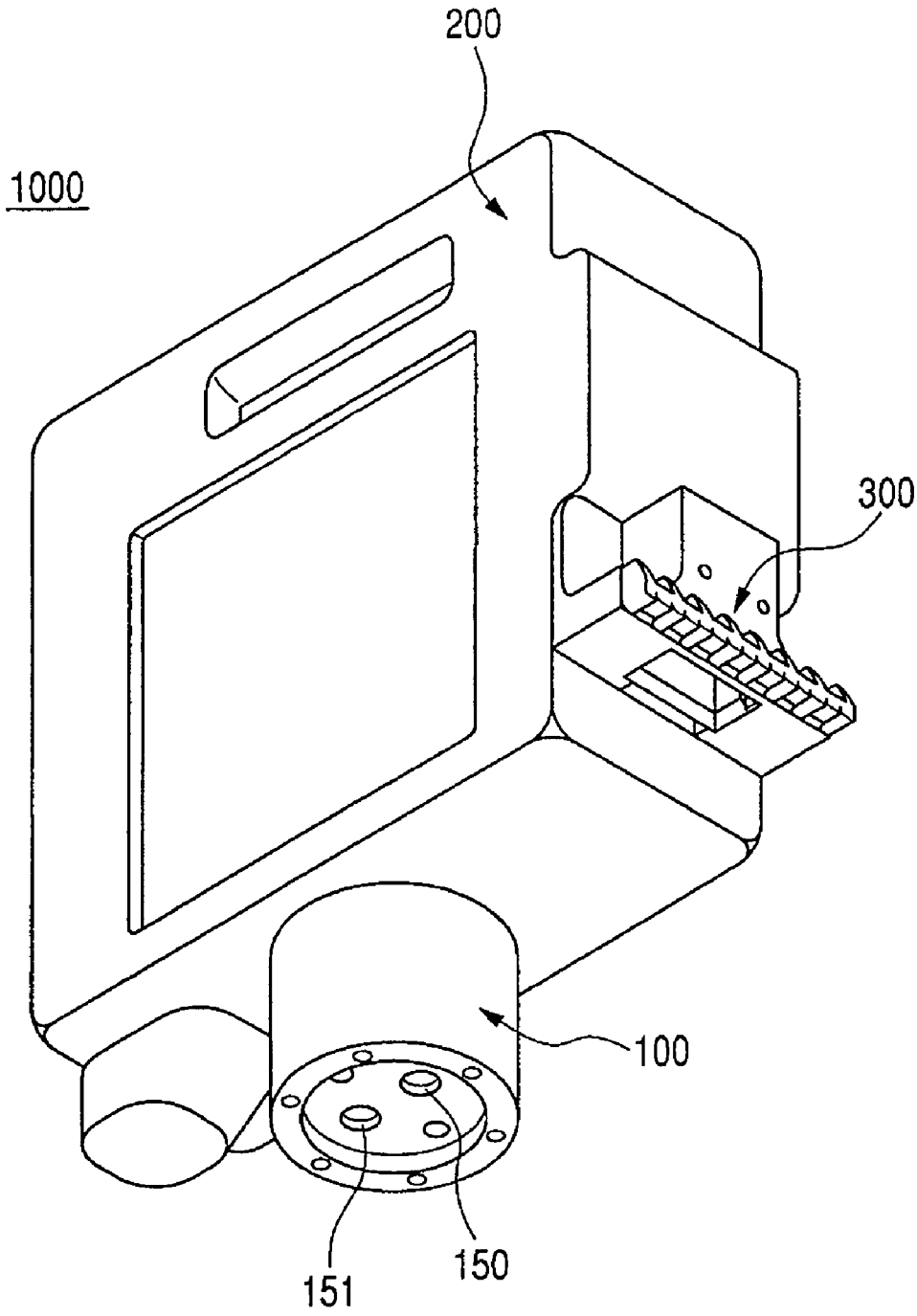
FIG. 2 is a perspective view of a liquid storing container in the first embodiment.
Figure 3:
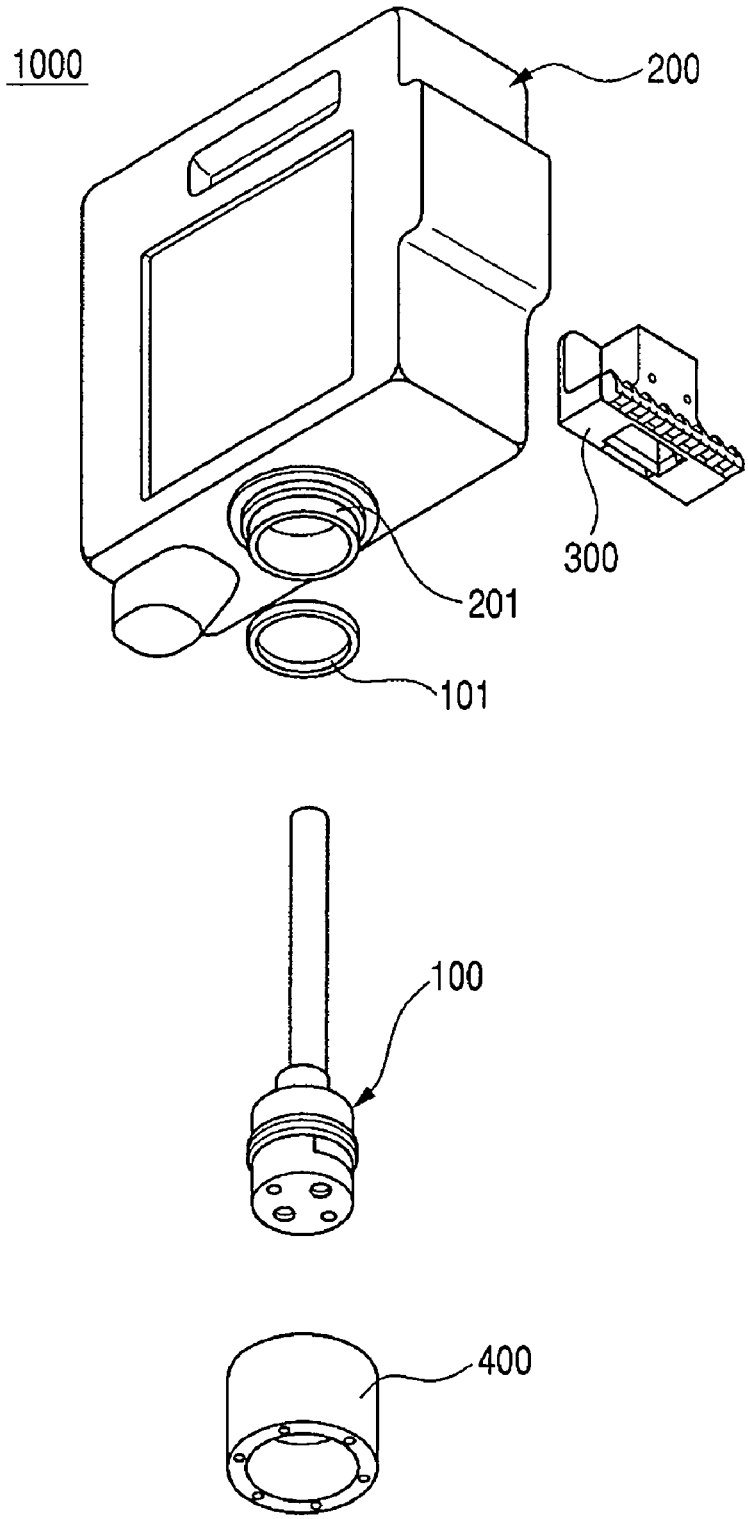
FIG. 3 is an exploded perspective view of a liquid storing container in the first embodiment.
Figure 4:
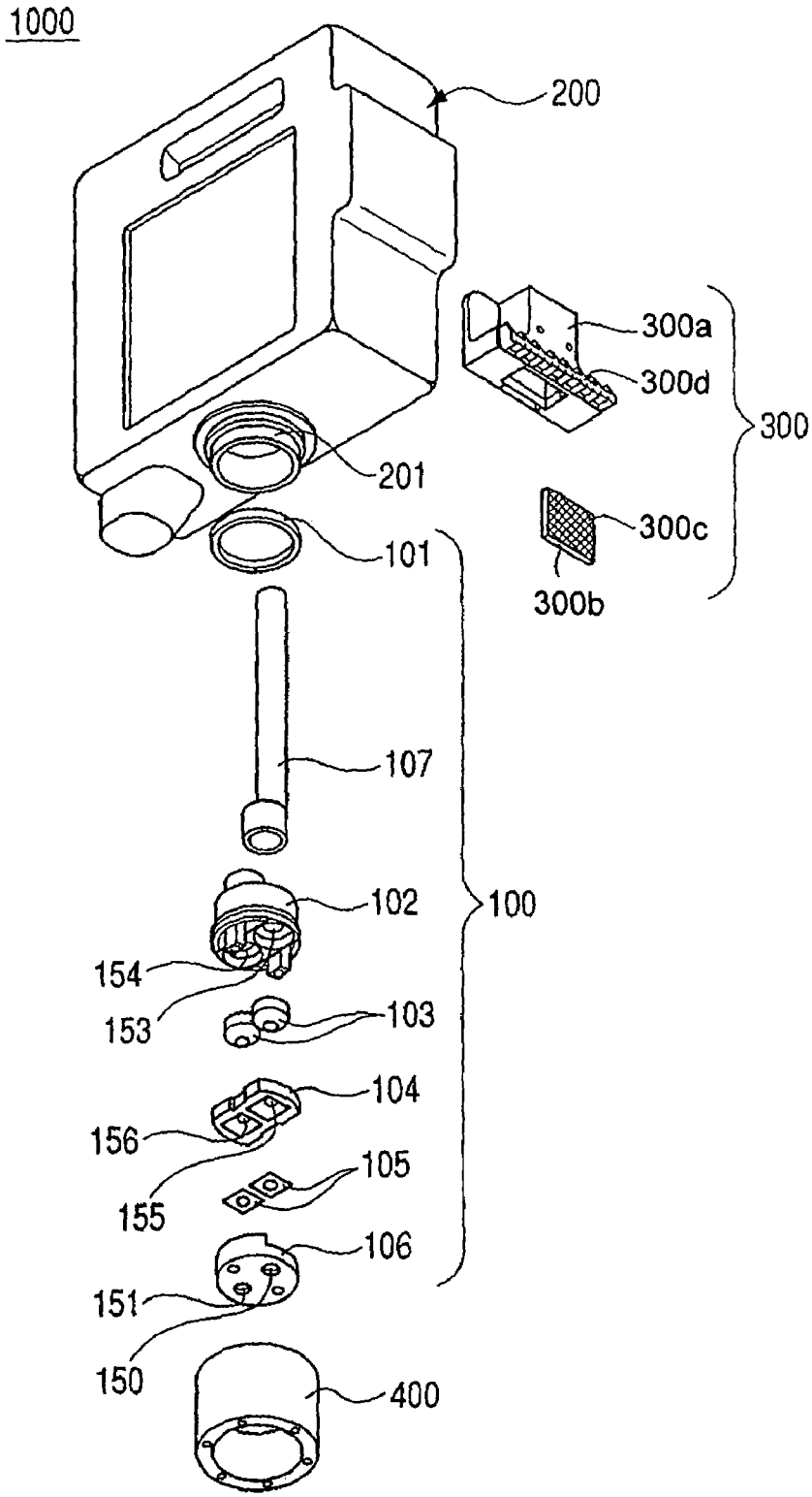
FIG. 4 is an exploded perspective view of a connection unit part of a liquid storing container in the first embodiment.
Figure 5:
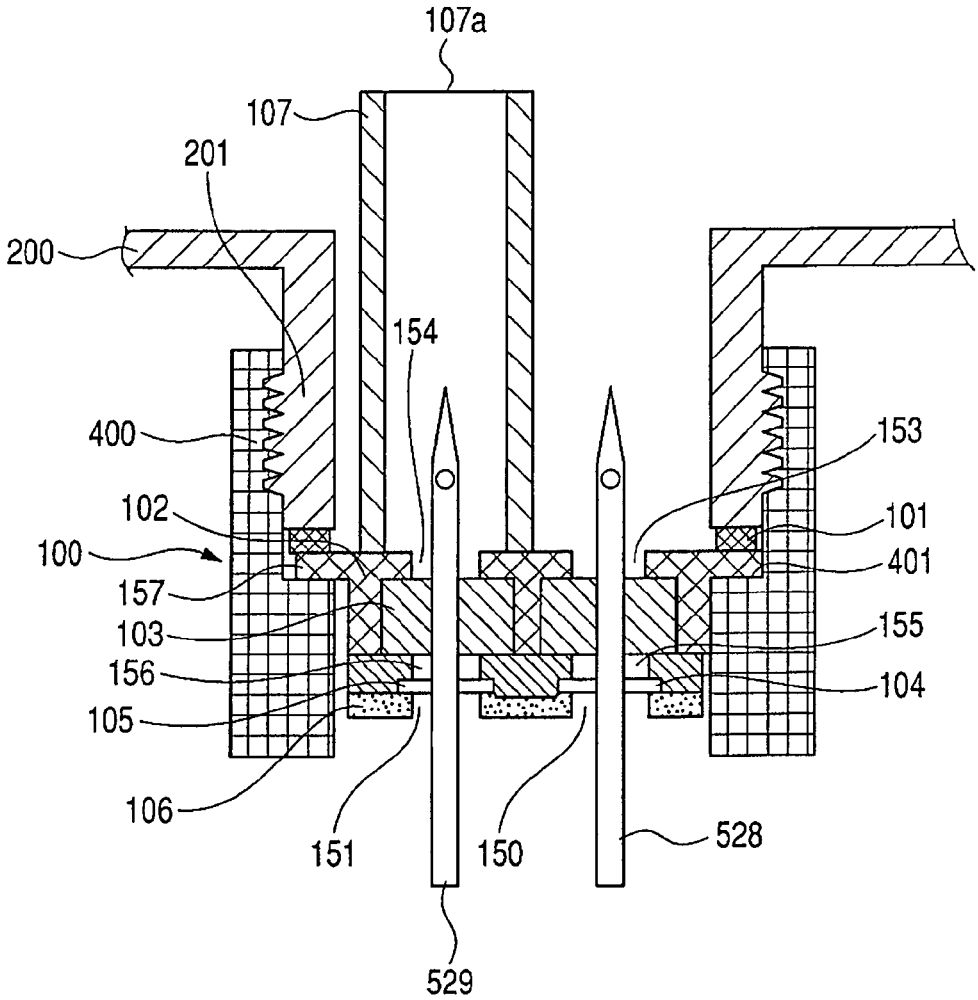
FIG. 5 is an enlarged vertical cross-sectional view of a connection unit of a liquid storing container.

FIG. 1 is a schematic block diagram of an ink jet recording apparatus which uses a liquid supply system according to the first embodiment of the present invention. FIG. 2 is a perspective view showing a liquid storing container in FIG. 1. FIG. 3 is an exploded perspective view of a liquid storing container in FIG. 2. FIG. 4 is an exploded perspective view of a connection unit 100 of a liquid storing container. FIG. 5 is an enlarged vertical cross-sectional view showing a detailed structure of a connection unit.

In FIG. 1 to FIG. 5, a liquid storing container 1000 is mounted on a recording apparatus, in a posture of directing connecting openings 150 and 151 in a connection unit 100 downward, and used. The connection unit 100 side with the connecting openings 150 and 151 makes the bottom of the liquid storing container 1000. When the liquid storing container 1000 is an ink tank as shown in FIG. 1, the liquid storing container 1000 is detachably mounted on a tank-mounting part of an ink supply unit 525 of an ink jet recording apparatus, in a state of directing connecting openings 150 and 151 downward. The ink tank is used for supplying ink to an ink jet recording head 524 as a recording unit.

Each component in a liquid storing container 1000 will be now described. As is shown in FIG. 3, the liquid storing container 1000 has a liquid storing portion (ink storing portion) 200 which is a main body of the container for storing a liquid (ink) therein, and a connection unit 100 for taking the liquid in the liquid storing portion 200 out. The liquid storing container 1000 further has an information storage medium unit 300 for taking out various kinds of information on the liquid storing container 1000, and a cap 400. The liquid storing portion 200 is a hollow container formed by blow-molding a plastic article. The connection unit 100 has first and second connecting portions which make a hollow needle for supplying the liquid (ink supply needle) 528 for forming a first communication hole, and a hollow needle (air introduction needle) 529 for forming a second communication hole inserted therethrough. The connection unit 100 is pressed to and hermetically sandwiched by an opening part 201 of the liquid storing portion 200 through a sealing member 101. The cap 400 is thread-fastened to a circumferential external screw of the opening part 201 so as to hold the connection unit 100 by pressing it toward the opening part 201. The information storage medium unit 300 is positioned and fixed on a side face of the liquid storing portion 200, by ultrasonic welding.

A connection unit 100 will be now described in detail with reference to FIG. 4 and FIG. 5. The connection unit 100 has a plurality of connecting portions, and a housing 102 where openings 153 and 154 which correspond to the connecting openings 150 and 151 that communicate with each connecting portion, are formed. The connection unit 100 further has two elastic members 103, a pressing member 104, two absorbers 105, an absorber cover 106 and a pipe 107; and is constituted by integrating the above all components. The two rubbery elastic members 103 are mounted at positions corresponding to communication holes 153 and 154 of the housing 102. The pressing member 104 has openings 155 and 156 corresponding to the connecting openings 150 and 151. The two absorbers 105 are arranged in the pressing member 104. The absorber cover 106 is mounted outside the two absorbers 105. A cylindrical member 107 is a pipe body having top and bottom ends opened, and the bottom end is fixed on the housing 102.

A liquid storing container 1000 is thus constituted by combining a liquid storing portion 200 and a connection unit 100. The connection unit 100 is mounted to an opening part 201 of the liquid storing portion 200. The connection unit 100 has a first connecting portion for leading a liquid out from the liquid storing portion, and a second connecting portion for introducing a gas (air) into the liquid storing portion. The first connecting portion has a hollow needle (ink supply needle) 528 for supplying the liquid inserted therethrough, which forms a first communication hole for leading the liquid out from the liquid storing portion 200. The second connecting portion has a hollow needle (air introduction needle) 529 for introducing a gas (air) inserted therethrough, which forms a second communication hole for introducing the gas into the liquid storing portion 200. In addition, an elastic member 103 is held in these connecting portions in a compressed state. Connecting openings 150 and 151 are formed in an absorber cover 106. In addition, a pressing member 104 is fixed on a housing 102 by ultrasonic welding or a locking pawl (not shown).

Each elastic member 103 is a rubbery member having a domed shape. The elastic members 103 are mounted in two respective recesses of a housing 102 and are compressively fixed by the pressing member 104. Thereby, the elastic member 103 generates a compressive reaction force in a radial direction, and maintains an airtightly sealed state. Two absorbers 105 arranged in the pressing member 104 are sandwiched by an absorber cover 106. The absorber cover 106 is fixed on the pressing member 104 or the housing 102 by ultrasonic welding or a locking pawl. A cylindrical member 107 having a length extending to the upper part in a liquid storing portion 200 is fixed, on the top face of the housing 102 and at a site surrounding a communication hole 154 through which an air introduction needle 529 for forming a second communication hole is inserted. The cylindrical member is located in the liquid storing container, and the upper end 107*a* is opened at a space over a liquid surface in a liquid storing portion 200. The cylindrical member 107 forms a space inside it, in which air exists. The air introduction needle 529 forms a second communication hole which communicates with a space of the air existing in the upper part of a liquid storing container and with the air in a cylindrical member. On the bottom of the cylindrical member 107, some amount of a liquid may remain as long as it does not hinder the air introduction needle 529 from passing the air therethrough. The cylindrical member 107 is fixed onto a housing 102 by ultrasonic welding, a locking pawl (not shown) or fitting. A connection unit 100 is thus constituted.

As is shown in FIG. 5, a connection unit 100 is fixed on an opening part 201 of a liquid storing portion (main body of container) 200 in a sealed state through a sealing member 101, by thread-fastening a cap 400 around a perimeter of the opening part 201. When a liquid storing container 1000 is used, a hollow needle 528 for supplying a liquid directly leads to the liquid storing portion 200, as is shown in FIG. 5. On the other hand, the air introduction needle 529 protrudes into a cylindrical member 107 arranged in the main body of the container 200. The liquid supply needle and the air introduction needle pierce connecting openings 150 and 151, absorbers 105 and 105, communication holes 155 and 156, elastic members 103 and 103, and communication holes 153 and 154, and protrude into the main body 200 of the container. The liquid supply needle 528 forms a first communication hole for leading a liquid out, and the gas introduction needle 529 forms a second communication hole for introducing a gas. The gas described here indicates outside air taken from the outside of the liquid storing container into the liquid storing container.

A cap 400 shown in FIG. 5 has a cylindrical shape in which a side thread-fastened to a liquid storing portion 200 and a side facing to an ink supply unit 525 are both opened. Accordingly, connecting openings 150 and 151 formed in the connection unit 100 are constituted so as to be exposed to the ink supply unit side in a state of being fixed to the liquid storing portion 200 by the cap 400. The cap 400 to be thread-fastened to an opening part 201 of the liquid storing portion 200 has an engaging portion 401 for sandwiching the connection unit 100 between the opening part 201 and the cap 400 formed in an inner diameter portion. A sealing member 101 is compressed by a specified amount between a portion 157 with an annular step formed on a perimeter of a housing 102 and an end face of the opening part 201 of the liquid storing portion 200, by thread-fastening the cap 400. Thereby, the inside of an ink tank 1000 is hermetically sealed from outside air.

In the next place, an information storage medium unit 300 will be described. In FIG. 4, the information storage medium unit 300 has a holder 300*a* and a storage medium 300*b* positioned and fixed on the inner surface of a recess of the holder 300*a* by a double-face tape 300*c*. The information storage medium unit 300 has a ctenidial ID portion (tank-type mechanical identification portion) consisting of a plurality of protrusions 300*d* . The storage medium 300*b* can exchange information with an ink jet recording apparatus in a state at which a liquid storing container 1000 is mounted on the ink jet recording apparatus as an ink tank. The information exchanged with the recording apparatus includes an expiration date of ink, a quantity of the ink in the ink tank 1000 and a color of the ink. The recording apparatus can advise a user to exchange the ink tank, by making a control unit of the recording apparatus take out the above information and issue an alarm about the time-expired or the running out of the ink. Thereby, the recording apparatus can prevent the discoloration of ink or the increase of the ink viscosity from exerting a harmful effect on a recording image. The recording apparatus also is capable of preventing itself from producing records in a state of having run out the ink or producing records in a state of having improperly mounted the ink tanks thereon which contain the inks with different colors.

A storage medium 300*b* can employ various articles such as a flash memory and a write-at-once magnetic medium, as long as the medium is capable of acquiring identification information through an information acquisition unit such as magnetic, photomagnetic, electric and mechanical units. In an ink tank 1000 according to the present embodiment, an EEPROM is used which is electrically writable and erasable. The EEPROM is a storage medium which can hold ink-tank identification information, write information from the main body of a recording apparatus and add information stored in the main body of the recording apparatus thereon, or change or delete the stored information. The EEPROM is mounted on a printed substrate having a contact point electrically connected to an electrical signal connector installed in the main body of the recording apparatus.

A predetermined part of a ctenidial protrusion 300*d* is removed in correspondence with a color of ink or a model of a recording apparatus. The main body prepares a protrusion so as to face the removed part. Thereby, only a proper ink tank is mounted. In other words, improper mounting is prevented not only by a storage medium 300*b*, but also by a mechanical structure.

In the next place, an ink jet recording apparatus having employed a liquid supply system according to the present embodiment will be described as an example with reference to FIG. 1. In FIG. 1, a liquid storing container 1000 is connected to an ink jet recording head 524 of a recording unit through a connection unit 100. The recording head 524 discharges ink onto a recording medium through a discharge port on the basis of image information to record an image on the recording medium. The recording head 524 used in the present embodiment is an ink jet recording head for discharging ink by using thermal energy, and accordingly is provided with an electrothermal conversion body for generating the thermal energy.

In FIG. 1, a recording head 524 is connected to an ink tank 1000 through an ink supply path 526 and an ink supply unit 525. The ink supply unit is a tank-mounting part of an ink jet recording apparatus. The ink supply unit 525 has a hollow ink supply needle 528 and an air introduction needle 529 arranged therein. The ink supply needle 528 for leading ink toward the recording head outside a container penetrates an elastic member 103 of one connecting opening 150 of the ink tank 1000, and extends into a liquid storing portion 200. The ink supply needle 528 has a needle hole formed in the vicinity of a tip. Thus, a first communication hole is formed, which constituted by the hollow needle for leading ink from the inside of the container to the outside. Though the ink supply needle 528 penetrates the elastic member 103, the elastic member 103 prevents the ink from leaking, because of being filled in a compressed state and consequently keeping a peripheral surface of the ink supply needle 528 hermetic. In the ink supply unit 525, a flow path 531 is arranged so as to connect an ink supply needle 528 with an ink supply path 526. The ink supply path 526 is placed outside the ink supply unit, and shows the flow path leading to the recording head. At some midpoint of a flow path 531 in the ink supply unit, a pump 304 and an opening/closing valve 302 are installed. The pump 304 can compressively transport a liquid and air existing in the flow path, and can switch a compressive transportation direction to any one of an arrow (A) and an arrow (B) in FIG. 1. When ink in the container is supplied to the recording head, the ink is compressively transported in a direction shown by the arrow (A).

An air introduction needle 529 for introducing outside air into the container from outside a container when ink is supplied to a recording head penetrates an elastic member 103 at a connecting opening in another side 151 of an ink tank 1000, and extends into a liquid storing portion 200. The air introduction needle 529 has a needle hole formed in the vicinity of a tip. Thus, the hollow needle forms a second communication hole for introducing air from the outside when ink is supplied to a recording head. Though the air introduction needle 529 penetrates the elastic member 103 at this time as well, the elastic member 103 prevents the ink from leaking, because of being filled in a compressed state and consequently keeping a peripheral surface of the air introduction needle 529 hermetic. The air introduction needle 529 has one end which communicates with an internal space of a cylindrical member 107 and has the other end which communicates with outside air through a flow path 532 formed in an ink supply unit 525. In the flow path 532, an opening/closing valve 303 is installed. Incidentally, in the present embodiment, a third flow path 533 is installed so as to connect a flow path 531 with the flow path 532, and an opening/closing valve 301 is arranged in the flow path 533.

In the next place, an ink-supplying action in an ink jet recording apparatus with the use of a liquid supply system according to the first embodiment will be described with reference to FIG. 1 to FIG. 5. The ink-supplying action is performed according to a liquid supply mode of the recording apparatus. In the FIGS. 1 to 5, a liquid storing container 1000 corresponds to an ink tank of the ink jet recording apparatus. In FIG. 1, flow paths 531, 532 and 533 are arranged in an ink supply unit 525. The first flow path 531 connects an ink supply needle 528 with a recording head 524 through a flow path 526. At some midpoint of the first flow path 531 in a configuration of FIG. 1, a pump 304 and an opening/closing valve 302 are installed. The pump 304 configures a driving unit for supplying a liquid or a gas.

A second flow path 532 is arranged in an ink supply unit 525, and connects an air introduction needle 529 and outside air. At a position in some midpoint of the second flow path 532 as shown in FIG. 1, an opening/closing valve 303 is installed. The third flow path 533 connects the first flow path with the second flow path. Accordingly, the third flow path 533 communicates an ink supply needle 528 with the air introduction needle 529 by connecting the two flow paths. The third flow path 533 further includes a portion between a pump 304 and an opening/closing valve 302 in the first flow path 531. The third flow path 533 still further includes a portion between the pump 304 and the valve 303, and the portion between the air introduction needle 529 and the pump 304. At some midpoint of the third flow path 533, the opening/closing valve 301 is installed. When an ink tank is mounted on the ink supply unit 525, the above described three flow paths are connected with each other through the ink tank.

A recording head 524 discharges ink from a discharge port formed in its discharge face to record an image on a recording medium. In order to refill the ink consumed by discharge, a pump 304 supplies the ink stored in an ink tank 1000 to the recording head 524 through ink supply paths 531 and 526. At this time, valves 302 and 303 are in an opened state and an opening/closing valve 301 is in a closed state. When the ink is supplied, the ink stored in a liquid storing portion 200 decreases, and consequently a pressure in the liquid storing portion decreases. Then, outside air flows towards the inside of the liquid storing portion from a flow path 532 communicating with the outside of a recording apparatus through an air introduction needle 529 and a cylindrical member 107, and is introduced into a space over a liquid surface of the liquid storing portion 200.

Figure 6:
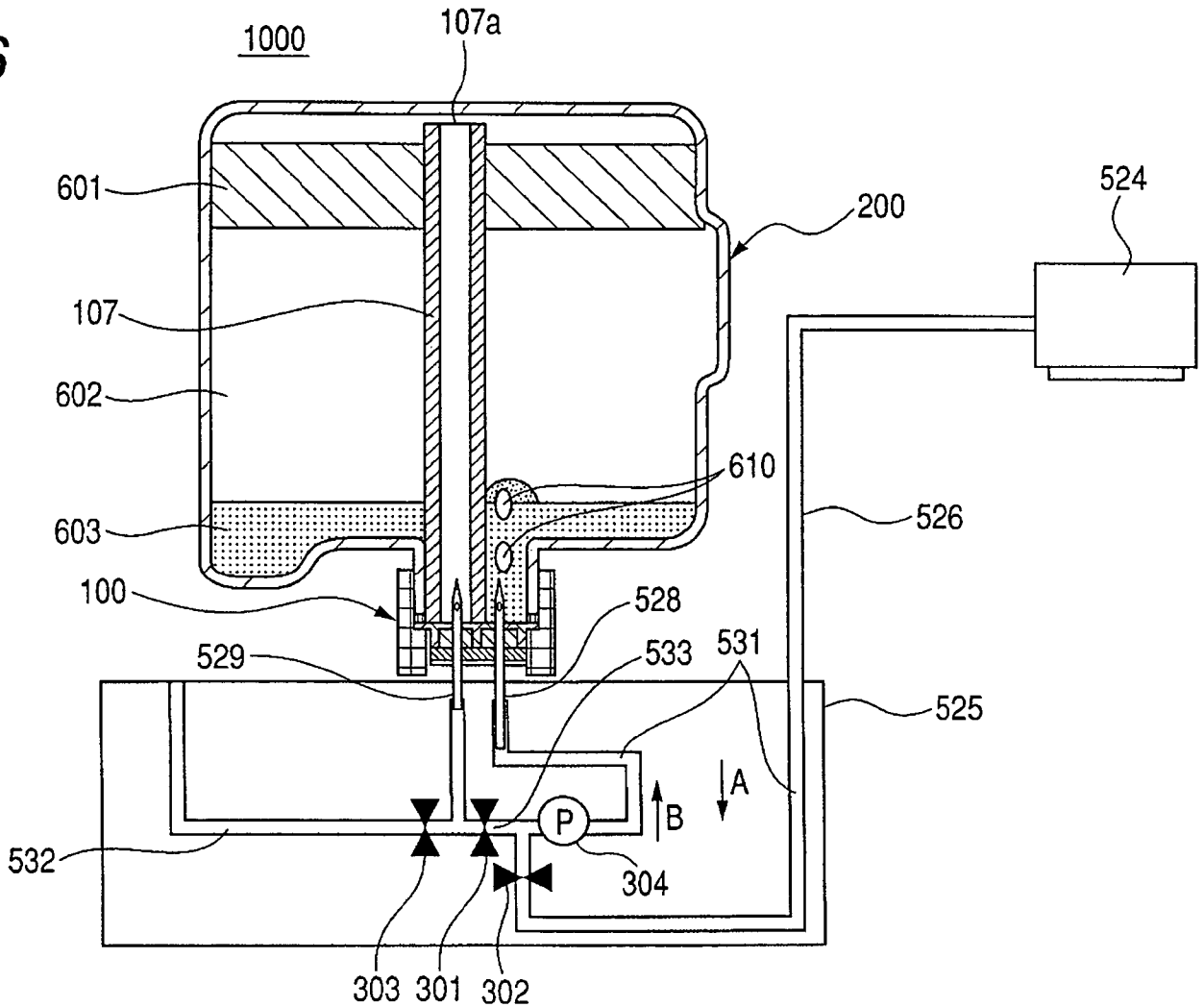
FIG. 6 is a schematic block diagram showing a state of air when the air forced into a liquid storing portion through a first communication hole is mixed with ink in a high-concentration layer in a liquid supply system according to the first embodiment.
Figure 7:
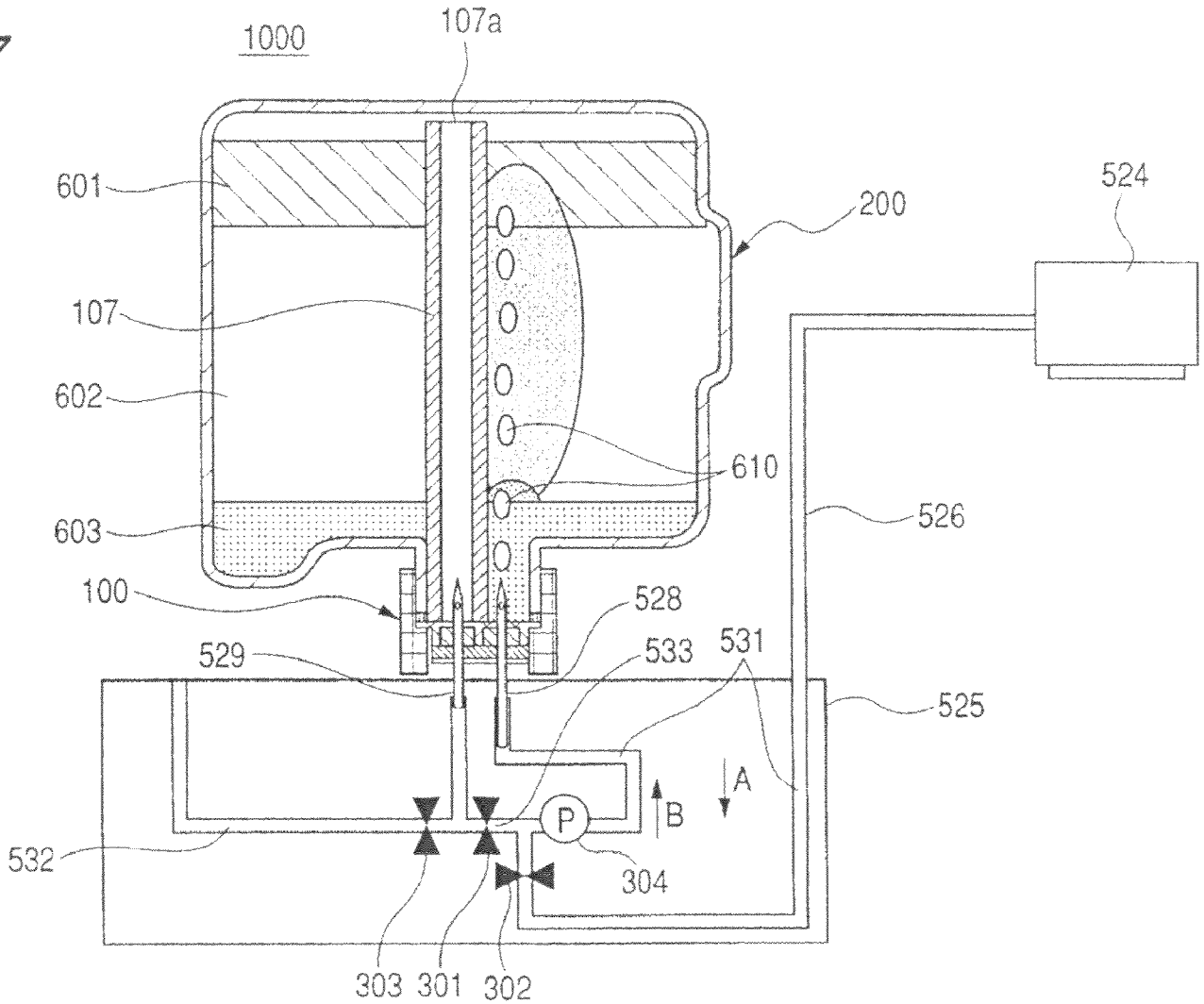
FIG. 7 is a schematic block diagram showing a state of air when the air forced into a liquid storing portion is mixed further with ink in a middle-concentration layer and a low-concentration layer in a liquid supply system according to the first embodiment.
Figure 8:
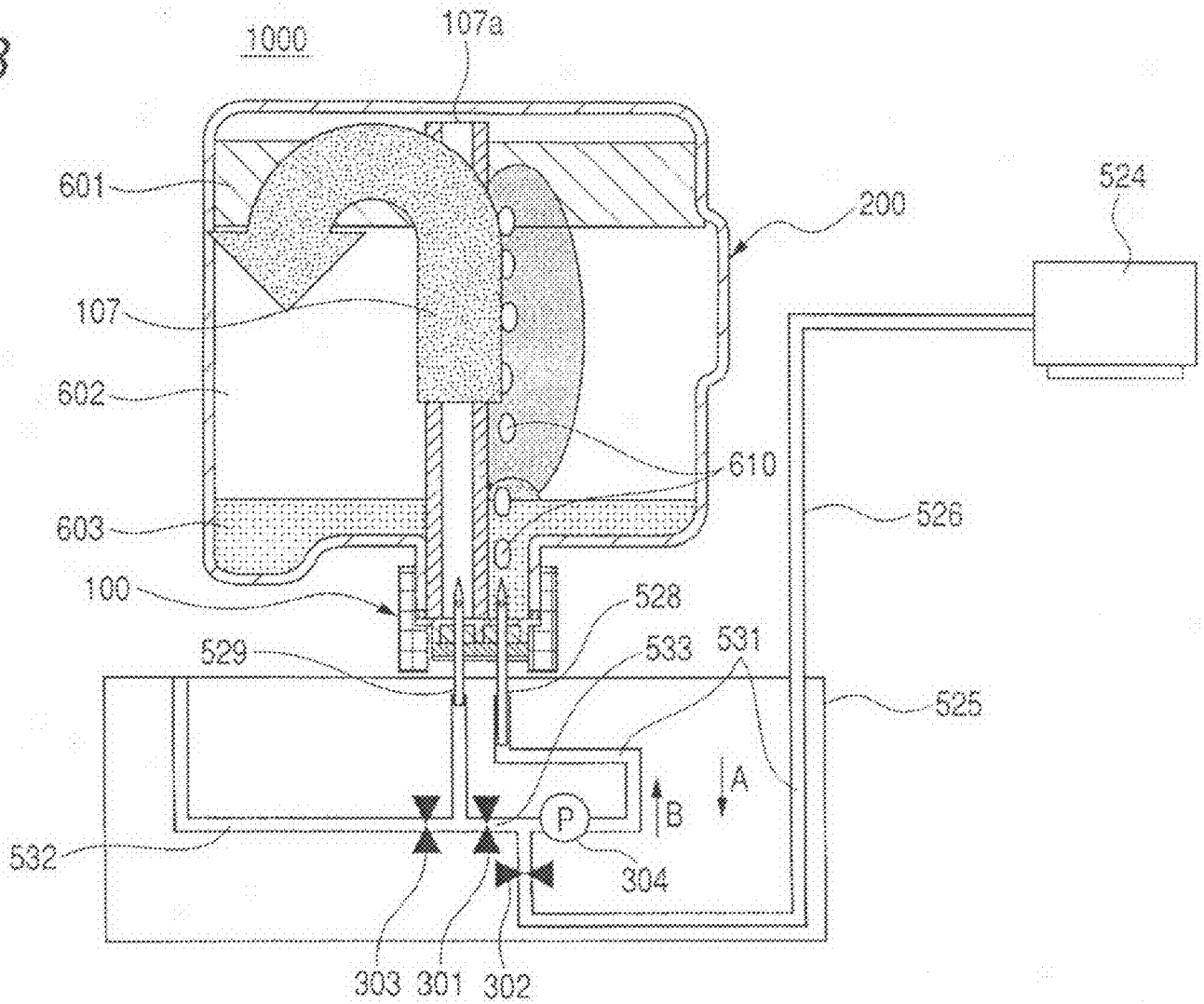
FIG. 8 is a schematic block diagram showing a state of the air and a liquid when those in a liquid storing portion are entirely agitated in a liquid supply system according to the first embodiment.

FIG. 6 to FIG. 8 are schematic block diagrams showing a state when a liquid supply system in FIG. 1 conducts a gas circulating mode in the tank circulating a gas (air) in a liquid storing portion, which is a different mode from a liquid supply mode for supplying ink to a recording head. Through a gas circulation mode, a liquid in the liquid storing portion can be agitated. FIG. 6 is the schematic block diagram showing a state of the liquid supply system in FIG. 1, in which air is forced into the liquid storing portion through an ink leading needle, and is mixed with the ink in a high-concentration layer. FIG. 7 is the schematic block diagram showing the state of the liquid supply system in FIG. 6, in which air is forced into the liquid storing portion, and is further mixed with the ink in a middle-concentration layer and a low-concentration layer. FIG. 8 is the schematic block diagram showing the state of the liquid supply system in FIG. 6, in which the air and the liquid are entirely agitated in the liquid storing portion.

In the next place, the state of a liquid storing portion 200 will be described in which pigmented ink containing a pigment particle of a coloring agent is stored. In FIG. 1 and FIG. 6 to FIG. 8, while an ink tank 1000 of a liquid storing container is left in a state of being mounted (usage state) for a long period of time, the pigment particles sediment in the tank. As a result, the pigment particles cause the concentration irregularity inside a liquid storing portion 200 in a direction from the bottom part to the top part. In this case, the concentration irregularity shows higher concentration in the bottom part than in the top part.

The state of the concentration irregularity of pigment particles is shown in FIG. 1 and FIG. 6. Specifically, a high-concentration layer 603 containing a high concentration of the pigment particles forms in the bottom part; a low-concentration layer 601 containing a low concentration of the pigment particles forms in the top part; and a middle-concentration layer 602 having the pigment particle concentration kept in the initial state forms, in a middle layer between them. In the above state, suppose that an opening/closing valve 301 is opened and opening/closing valves 302 and 303 are closed. In the state, the ink tank 1000 forms a closed system through a pump 304. Two needles 528 and 529 penetrating the tank form flow paths which communicate with each other through the pump 304 and the valve 301. In thus closed system, the pump 304 which is a driving unit for supply is driven to circulate and move a gas in a direction of an arrow (B). In this case, a top opening part 107*a* of a cylindrical member 107 is located at a higher position than a liquid surface of the low-concentration layer 601 in the top part.

As a result of this, air existing in an upper part in a liquid storing portion 200 is led outside a tank, through a cylindrical member 107 and an air introduction needle 529; and at the same time, the led air is forced into the liquid storing portion 200 through the ink supply needle 528 in the flow path. Air in an upper space of a liquid storing portion 200 is led outside a tank through a cylindrical member 107 and an air introduction needle 529, by the drive of a pump 304. The air led outside the tank by the drive of the pump 304 is introduced into the liquid storing portion 200 through the ink supply needle 528. In other words, the air in the liquid storing portion 200 passes an inner part and outer part of the tank through the cylindrical member, the air introduction needle, the pump and the ink supply needle, then is returned into the tank again to be circulated.

In the structure, a pump 304 makes air existing in an upper part of an ink tank 1000 circulate through a closed flow path of an ink supply unit 525, and thereby agitates the ink in the ink tank. A gas existing in the upper part in a liquid storing portion 200 is circulated through a closed system formed in an ink supply unit 525, and is mixed with the ink in the liquid storing portion 200. When the gas circulation mode is conducted, the ink can be agitated by the behavior of the gas and the ink, which occurs while the gas is mixed with the ink. The ink in the ink tank is agitated by the movement of the circulated gas in the container, without being wasted.

On the other hand, a posture of an ink tank 1000 changes in every direction in a circulation process after having been produced and before being attached to a main body of a recording apparatus. When the posture has changed, the ink may flow into a cylindrical member 107. Accordingly, the ink may exist in the cylindrical member 107 immediately after the ink tank 1000 is attached to the main body of the recording apparatus. The ink thus existing in the cylindrical member 107 is circulated in a direction of an arrow (B) of the needle 529 and is reintroduced into the ink tank 1000, by forming a closed flow path system which starts from the air introduction needle 529 and ends at the ink supply needle 528, and then by driving a pump 304. In other words, the ink which has been led from the inside of the cylindrical member 107 to the outside of the ink tank is circulated and is introduced again into the ink tank. In this case as well, the ink is not wasted. The ink which has been once led from the inside of the cylindrical member 107 to the outside of the ink tank merges with the ink in the tank. The ink does not flow into the cylindrical member 107 again through the top part 107*a* of the cylindrical member.

In the next place, an agitating action of ink will be described which occurs when the air in an ink tank 1000 is circulated and is introduced again from a bottom of the ink tank. In FIG. 6, the air 610 which has been introduced from the bottom of the ink tank 1000 through a first communication hole of an ink supply needle 528 moves up towards an upper part in a container. By the movement of the air, a high-concentration layer 603 of a pigmented ink is pushed up, and one part of the high-concentration layer 603 is mixed into a middle-concentration layer 602. Here, a liquid layer constituted of the high-concentration layer 603 and the middle-concentration layer 602 have different properties from those of one gas cluster 610 formed of air. At first, the layer 603 containing a high-concentration of pigment particle is pushed up-by the air 610 towards the upper part. The high-concentration layer has a higher specific gravity (is heavier) than that of the surrounding middle-concentration layer 602. In addition, the middle-concentration layer 602 is standing still, and has lower specific gravity than that of the high-concentration layer 603 which has entered the middle-concentration layer. Furthermore, the air 610 moves up to the upper part, and has lower specific gravity than those of the two liquid layers 602 and 603.

Because the liquid layers and the air have the different properties as described above, the high-concentration layer 603 is temporarily pushed up by the air 610, but an ink of a part of a high-concentration layer separated from the air 610 subsequently sediments due to its larger specific gravity than that of the middle-concentration layer 602. On the other hand, the movement of the air is affected by a state of a surrounding liquid, because the air 610 is lighter than the other two liquid layers. In other words, the air 610 does not move up linearly but moves up shakily. Furthermore, the air 610 moves up continuously due to the circulation of the above described air, and creates a complicated flow of the air. Therefore, the high-concentration layer 603, air 610 and the middle-concentration layer 602 are jumbled, and pigment particles in ink are further diffused and mixed.

Then, as shown in FIG. 7, the jumbled ink of each pigmented ink in a middle-concentration layer 602 and a high-concentration layer 603 same as shown in FIG. 6 is pushed up into a low-concentration layer 601 by air 610; and pigment particles in the ink are thereby agitated. An agitation mechanism in the above case is the same as in the case of the above described high-concentration layer 603, the air 610 and the middle-concentration layer 602. Specifically, as shown in FIG. 8, when a pump 304 is operated, the air 610 moves up in a tank 1000 and is mixed with the ink during the movement. At the same time, the air above a liquid surface in the ink tank enters the inside of a cylindrical member from the cylindrical member 107*a*, and is led outside the tank by way of an air introduction needle 529. The led air is introduced into the ink tank 1000 through the ink supply needle 528 by a pump 304, and is mixed with the ink while moving up in the ink tank. Thus, the air 610 is circulated between the inside and the outside of the tank through the cylindrical member 107, and repeats agitating the ink in the tank. And when, the air 610 moves up continuously from the bottom to the upper part of the ink tank 1000, thereby creates a flow of the ink as shown by an arrow in FIG. 8 in the ink tank, and agitates the ink in the ink tank.

As described above, a liquid supply system according to the embodiment can agitate ink in a liquid storing container, by utilizing air in the liquid storing container 1000, circulating it through the outside of the container into the container again. Thereby, even when pigmented ink is used for a long period of time in the liquid storing container 1000, the liquid supply system can prevent the ink from forming density difference in an image recorded on a recording medium. In other words, even when an apparatus is left unattended for a long period of time, the ink with the suitable concentration can be still supplied from an ink tank 1000 to a recording head 524. Accordingly, there is provided the liquid storing container in a liquid supply system storing ink containing pigment as a coloring agent therein, which can record an image of high quality free from density difference without wasting the ink.

Figure 10:
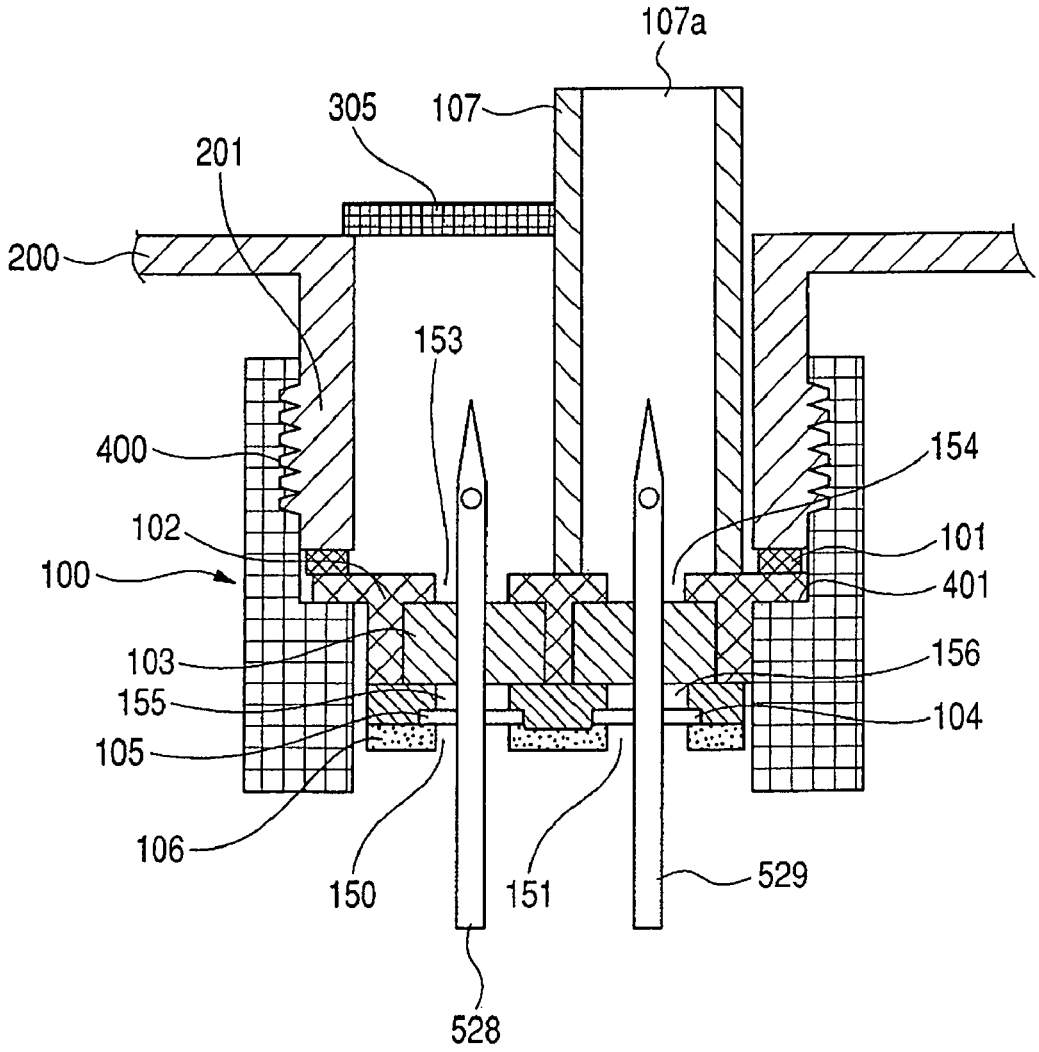
FIG. 10 is an enlarged vertical cross-sectional view of a connection unit for a liquid storing container in a liquid supply system according to the second embodiment.
Figure 11:
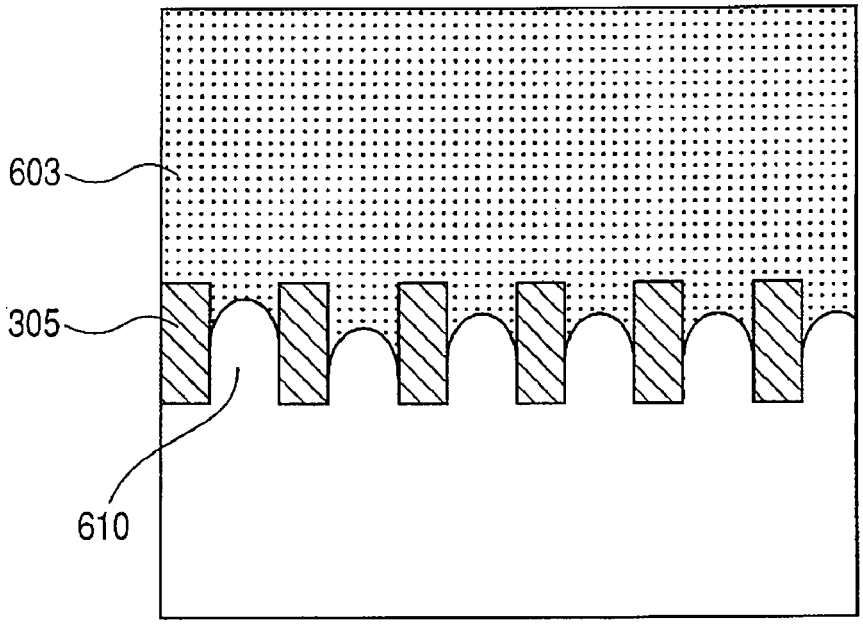
FIG. 11 is a schematic block diagram showing a state of a meniscus formed between air and ink in a filter portion in the second embodiment.
Figure 12:
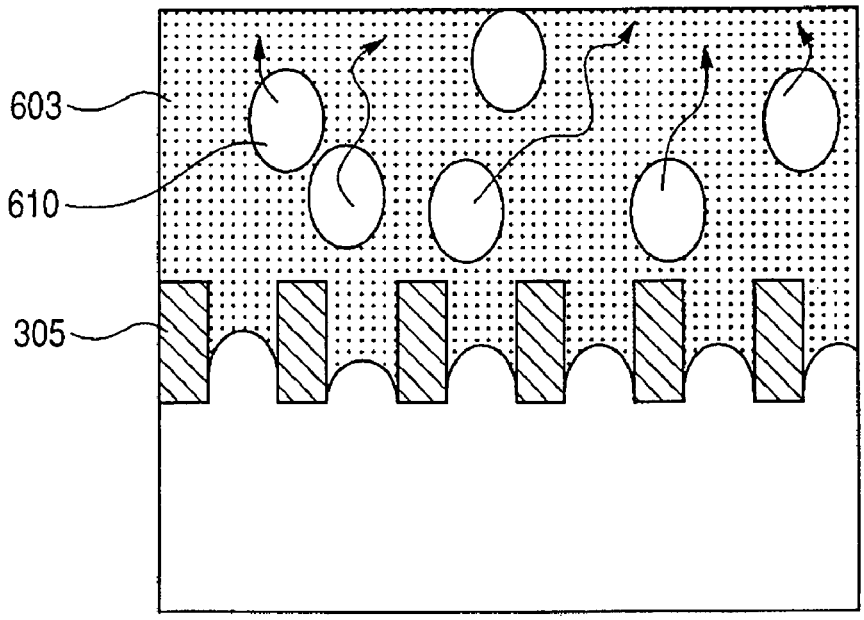
FIG. 12 is a schematic block diagram showing a state of the air which moves up in ink after having broken a meniscus.
Figure 13:
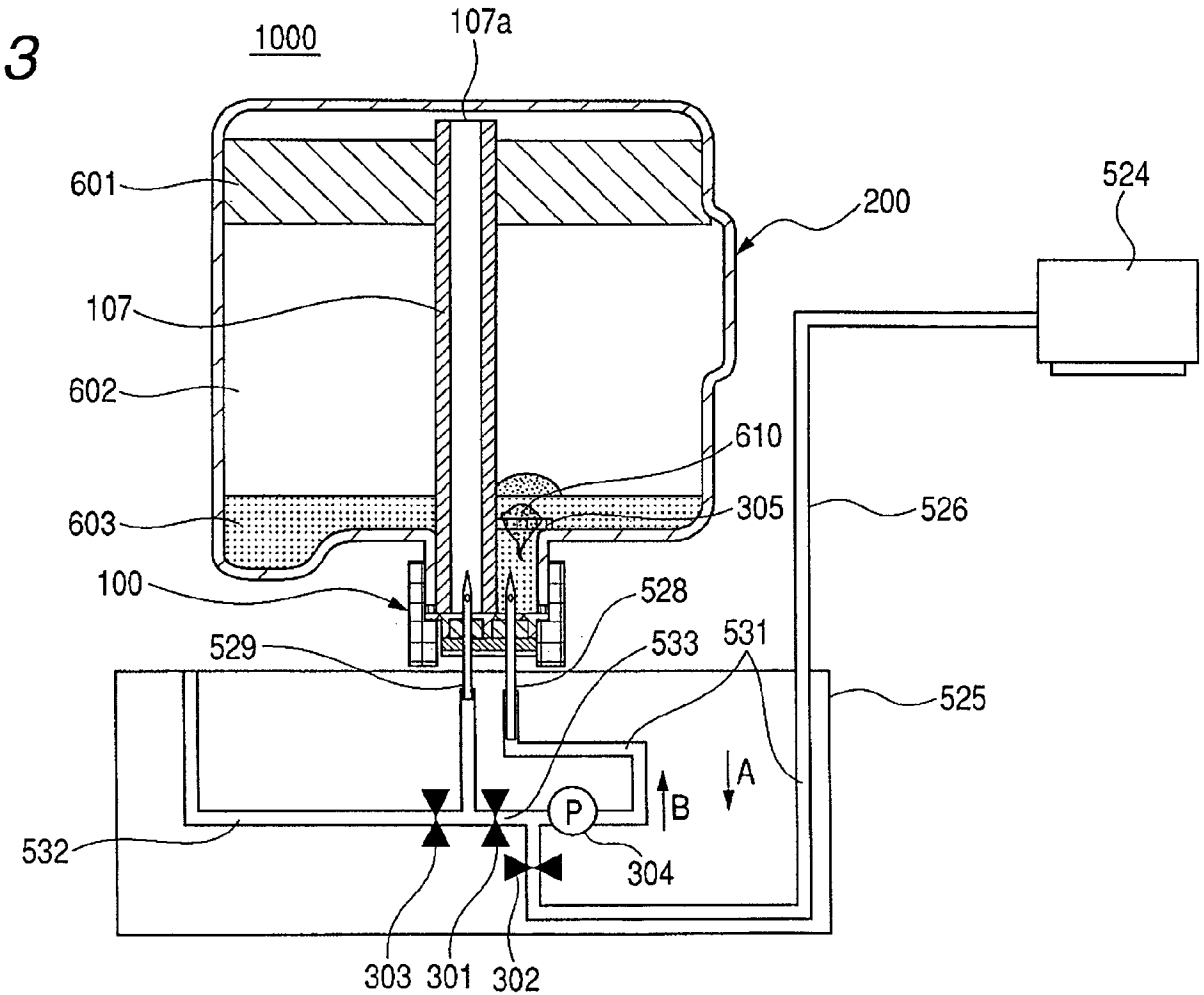
FIG. 13 is a schematic block diagram showing a state of a gas when the gas forced through a first communication hole is mixed with ink in a high-concentration layer in an ink jet recording apparatus which employs a liquid supply system according to the second embodiment.
Figure 14:
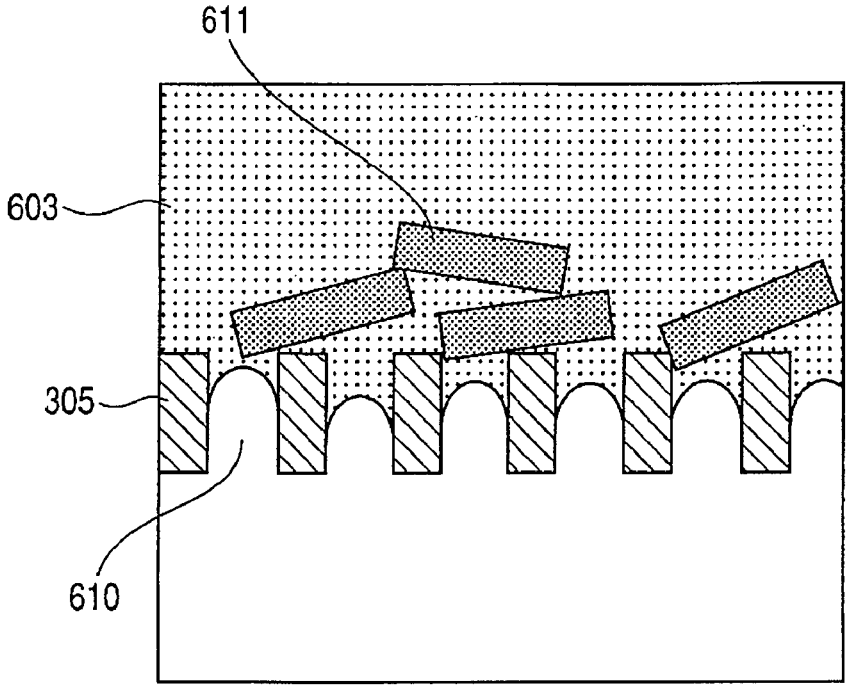
FIG. 14 is a schematic block diagram showing a state of a foreign article in ink, which is depositing on a filter.
Figure 15:
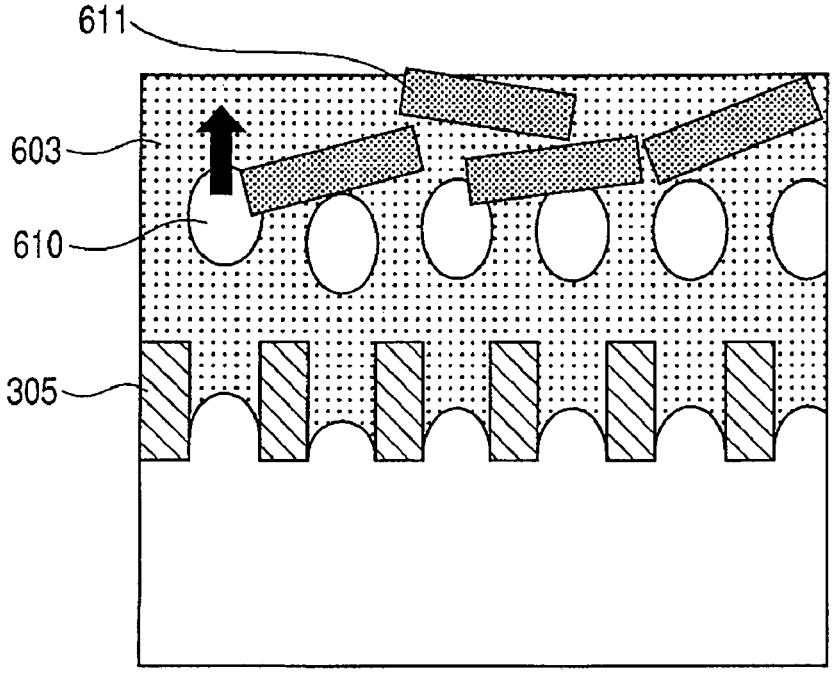
FIG. 15 is a schematic block diagram showing a state of a foreign article on a filter, which is being removed by air that is moving up after having broken a meniscus in the filter.

FIG. 10 is an enlarged vertical cross-sectional view showing a detailed structure of a connection unit of a liquid storing container in a liquid supply system according to the second embodiment of the present invention. FIG. 11 is a schematic block diagram showing the state of a meniscus between air and ink in a filter in FIG. 10. FIG. 12 is a schematic block diagram showing the state of the air which moves up in ink after having broken a meniscus of a filter in FIG. 11. FIG. 13 is a schematic block diagram showing a state of a gas when the gas forced into the liquid storing container through the first communication hole is mixed with ink in a high-concentration layer through a filter, in a liquid supply system according to the second embodiment of the present invention. FIG. 14 is a schematic block diagram showing a state of a foreign article in ink, which is depositing on the filter in FIG. 10. FIG. 15 is a schematic block diagram showing a state of a foreign article on a filter, which is being removed by air that is moving up after having broken a meniscus in the filter in FIG. 14. In the next place, the liquid storing container of the liquid supply system according to the second embodiment of the present invention will be described in detail with reference to FIG. 10 to FIG. 15.

A configuration of the whole liquid supply system which employs a liquid storing container 1000 as an ink tank of an ink jet recording apparatus is substantially the same as in the first embodiment shown in FIG. 1, so that the detailed description will be omitted. As is shown in FIG. 10, in the present embodiment, a filter 305 is installed above a communication hole 153 of a housing 102 in a liquid storing portion 200. The filter 305 is used for removing a foreign article existing in the liquid storing portion 200, when operating a pump 304 in FIG. 1 in a direction of an arrow in the figure and supplying ink to a recording head 524. Accordingly, the filter 305 is arranged so as to circulate only the ink while intercepting the foreign article in the ink.

In recent years, a resolution in an image recorded by an ink jet recording apparatus has been extremely increasing, so that an individual ink drop (dot) constituting the image becomes extremely small, and a discharge port for discharging such an ink drop becomes extremely small. For this reason, when a foreign article is mixed in the ink to be supplied to a recording head 524, the ink tends to cause clogging in the discharge port and a failure of discharge. With respect to such a technical problem, a filter 305 shown in FIG. 10 is installed in the present embodiment, so as to record an image of stable and high quality by removing the foreign article from the ink.

A liquid storing container 1000 of a liquid supply system according to the present embodiment additionally has the above described filter 305 mounted therein, which is different from the first embodiment, but is substantially the same in the other points. Accordingly, an ink-supplying action when the liquid storing container 1000 is used as an ink tank of an ink jet recording apparatus is substantially the same as in the above described first embodiment. In the next place, an agitation action in the present embodiment will be described, which is induced when air is circulated in the ink tank 1000 and is introduced again from the bottom of the ink tank. In the present embodiment, as shown in FIG. 11, the air 610 moves upward in the capillary while forming a meniscus between ink and the air 610 in a capillary of the filter 305; and after a while as shown in FIG. 12, breaks the meniscus, is mixed into the ink, and further moves up.

The moving of air 610 and timing of breaking the meniscus are affected by ink and the surface state of a filter 305. For this reason, an interval for the air 610 of mixing into the ink is at random, which complicates a flow of the air 610 and ink. The complicated flow promotes the mixing of the air into the ink, and enhances an agitation effect of pigment particles in the ink. As is shown in FIG. 12, an individual air bubble 610 is fine and light, and is easily affected by a flow around the air 610, so that the air 610 vigorously moves in the ink. Therefore, the air 610 moves up while drawing further complicated trajectory. At this time, the ink enters gaps between the air bubbles 610, makes the flow of the air and the ink complicated, thereby promotes the mixing of the air into the ink, and can further enhance the agitation effect.

In addition, individual air bubbles 610 are fine as described above. However, ink enters gaps between them and consequently forms a mixture of the moving-up air 610 and the ink, as shown in FIG. 13. Then, the mixture approximately integrally moves up. As a result of this, the air 610 even with the same volume can push up a larger amount of the ink. In addition, the air 610 is discharged from the top face of a filter 305 to an upper part by an agitating action. As a result of this, even when a foreign article 611 exists on the filter 305 as is shown in FIG. 14, the discharged air 610 can remove the foreign article 611 from the filter 305 while moving up, as is shown in FIG. 15. In the above case, the air 610 merely returns the foreign article 611 into the ink, so that while the ink is normally supplied, the foreign article 611 deposits again on the filter 305 though little by little. However, the smooth ink-supplying action can be maintained by conducting an agitating action in predetermined timing.

Figure 16:
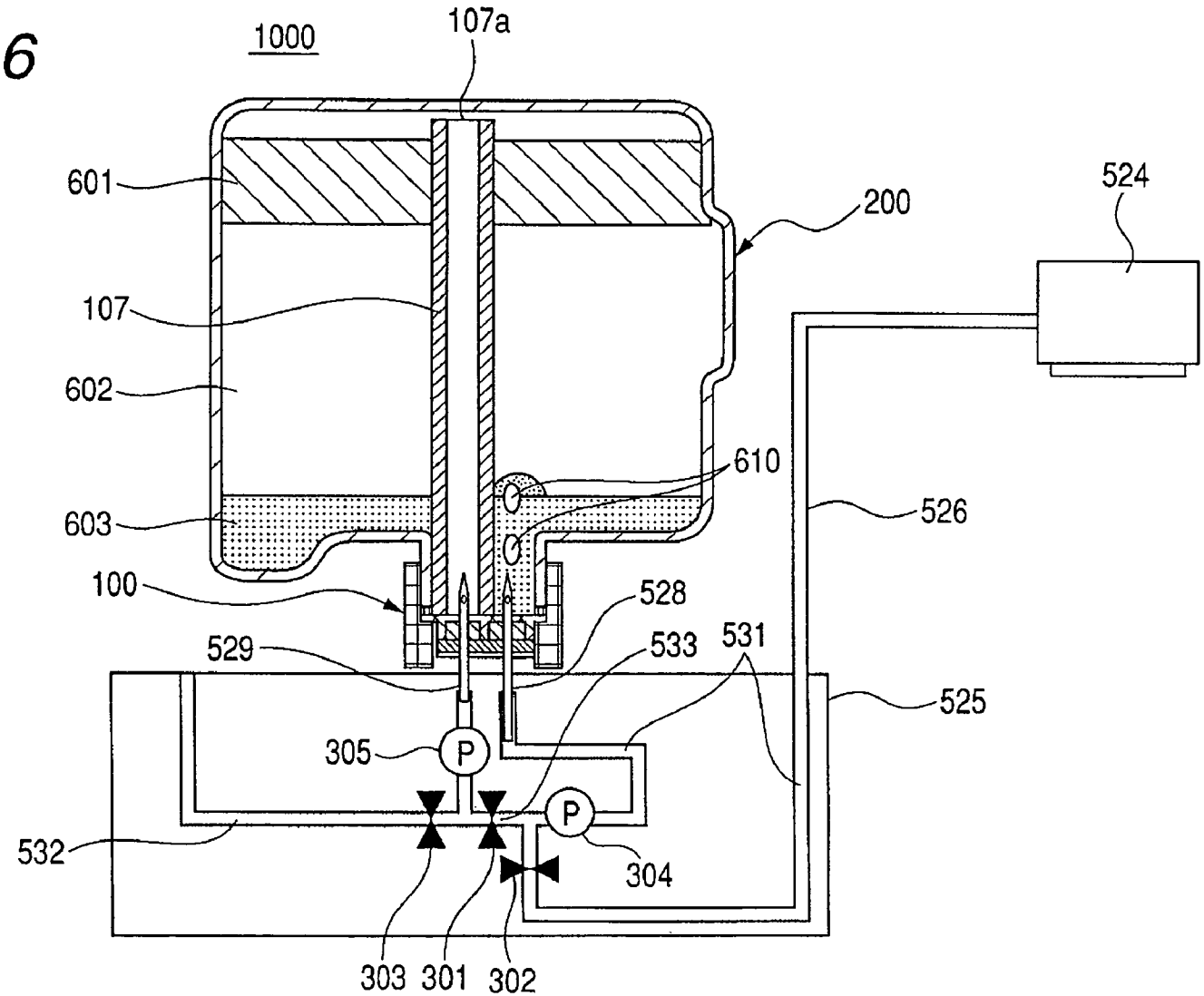
FIG. 16 is an explanatory layout drawing in the third embodiment, in which a driving unit for circulating a gas is arranged between a second communication hole and a third flow path.

FIG. 16 shows a configuration in the third embodiment, in which a pump 305 is installed between a second communication hole and a third flow path. In the configuration, a driving pump 305 leads a gas in a liquid storing container out into the third flow path by way of the second communication hole and the second flow path, and returns the gas into the liquid storing container again from the first flow path by the way of the first communication hole.

Figure 17:
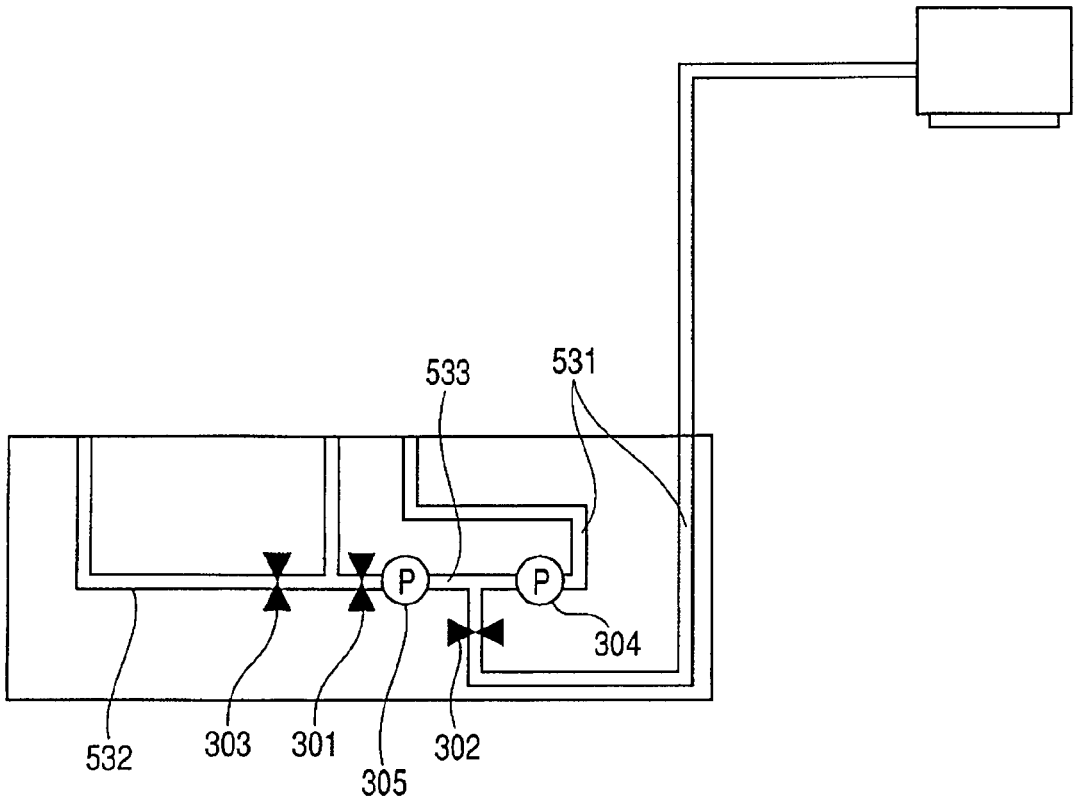
FIG. 17 is an explanatory layout drawing in the fourth embodiment, in which a driving unit for circulating a gas is arranged in a third flow path.

FIG. 17 shows a configuration in the fourth embodiment. In the configuration, a pump 305 is installed in a third flow path. In any configuration of any embodiment, a gas in a liquid storing container passes through a cylindrical member, a second communication hole, a second flow path, a third flow path, a first flow path and a first communication hole in that order, and returns into the liquid storing container again. A driving unit for circulating the gas may be arranged at such a position as shown in the third and fourth embodiments. A driving unit 304 supplies a liquid in the liquid storing container to a recording head, and a driving unit 305 circulates the gas.

In any embodiment, it is necessary to close an opening/closing valve 301 installed in the third flow path, when a liquid is supplied to a recording head. A first flow path for supplying the liquid to a head can be isolated from a second flow path for introducing outside air into a liquid storing container, by closing the valve 301.

When circulating a gas in each embodiment, it is necessary to open an opening/closing valve 301 installed in a third flow path, make a first flow path communicate with a second flow path, and close an opening/closing valve 303 installed in the second flow path and an opening/closing valve 302 installed in the first flow path.

Thereby, the liquid supply system can circulate a gas in a liquid storing container while using a third flow path, without introducing outside air and supplying a liquid to a head.

A liquid supply system according to the embodiment described above can agitate a liquid in a liquid storing portion only by circulating a gas in the liquid storing portion to the outside. A liquid storing container is provided which can prevent pigment particles from sedimenting and keep a liquid concentration uniform, even when storing the liquid containing pigment particles therein for a long period of time. Accordingly, when the liquid storing container is used in an ink tank of an ink jet recording apparatus, the liquid storing container and ink jet recording apparatus is provided which can record adequate image with desired concentration.

In the above described embodiments, an ink jet recording apparatus employing a liquid storing container as an ink tank was described taking a serial type which uses such a recording head moving along a recording medium. The present invention can be also applied to an ink jet recording apparatus of a line type which records an image only by vertical scanning an ink head. The present invention also can be similarly applied to any ink jet recording apparatus regardless of the number of recording heads, and of the number of types and properties of the ink. Furthermore, the present invention is not limited to a unit device such as a printer, a copying machine, a facsimile and an image-forming device; but also can be widely applied to a combined apparatus like a composite printing apparatus which combines the above unit devices, or a recording apparatus in a computer system.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-128136, filed May 2, 2006, which is hereby incorporated by reference herein in its entirety.

What is claimed is:

1. A liquid supply system to and from which a liquid storing container is capable of being attached and detached so as to direct a first communication hole and a second communication hole in a vertically downward direction, the liquid storing container being provided with a liquid storing portion, the first communication hole and the second communication hole that are arranged in one side face of the liquid storing portion, and a cylindrical member that is connected to the second communication hole and is installed in the liquid storing portion, the liquid supply system comprising:

a first flow path for connecting the first communication hole with a recording head;

a second flow path for communicating the second communication hole to outside air;

a third flow path for connecting the first flow path with the second flow path, and a driving unit for a gas or a liquid, wherein the driving unit is capable of circulating the gas stored in the liquid storing portion in order of the cylindrical member, the second communication hole, the second flow path, the third flow path, the first flow path and the first communication hole.

2. A liquid supply system according to claim 1, wherein the cylindrical member extends to an upper part above a liquid surface in the liquid storing container.

3. A liquid supply system according to claim 1, wherein the driving unit is installed in between the first communication hole and the third flow path.

4. A liquid supply system according to claim 1, wherein the driving unit is installed in between the second communication hole and the third flow path.

5. A liquid supply system according to claim 1, wherein the driving unit changes driving directions between when supplying the liquid stored in the liquid storing portion to the recording head, and when circulating the gas stored in the liquid storing portion into the liquid storing portion by way of the third flow path.

6. A liquid supply system according to claim 1, wherein when the gas in the liquid storing portion is circulated into the liquid storing portion by way of the third flow path, connection between the first flow path and the recording head is intercepted, and communication between the second flow path and outside air is intercepted.

7. A liquid supply system according to claim 1, wherein the attachable and detachable liquid storing container has a filter arranged at a position corresponding to the first communication hole in the liquid storing portion.

8. A liquid supply system according to claim 7, wherein the filter can form a meniscus.

9. A liquid supply system according to claim 1, wherein the liquid stored in the liquid storing portion includes a pigment particle.

10. An ink jet recording apparatus comprising: a recording head which discharges ink to a recording medium to record an image on the basis of image information; and the liquid supply system according to claim 1, which supplies the ink stored in the liquid storing container to the recording head.

11. An ink jet recording apparatus according to claim 10, wherein the ink includes a pigment particle as a coloring agent.

* * * * *